US008711194B2

(12) United States Patent
Tsuchiya et al.

(10) Patent No.: US 8,711,194 B2
(45) Date of Patent: Apr. 29, 2014

(54) PRINTER

(71) Applicant: Fujitsu Component Limited, Tokyo (JP)

(72) Inventors: Masahiro Tsuchiya, Tokyo (JP); Yukihiro Mori, Tokyo (JP); Sumio Watanabe, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/968,613

(22) Filed: Aug. 16, 2013

(65) Prior Publication Data

US 2014/0063170 A1 Mar. 6, 2014

(30) Foreign Application Priority Data

Aug. 28, 2012 (JP) ..... 2012-188053

(51) Int. Cl.
*B41J 25/304* (2006.01)
*B41J 25/316* (2006.01)

(52) U.S. Cl.
CPC ..... *B41J 25/304* (2013.01); *B41J 25/316* (2013.01)
USPC ..... 347/222; 347/220; 347/197; 400/120.16

(58) Field of Classification Search
USPC ..... 347/197, 198, 220, 222; 400/120.16, 400/693
See application file for complete search history.

(56) References Cited

U.S. PATENT DOCUMENTS 8,562,231 B2 * 10/2013 Maeda et al. ..... 400/663
8,610,752 B2 * 12/2013 Tsugaru ..... 347/222

FOREIGN PATENT DOCUMENTS

JP 11-129571 5/1999
JP 11-157107 6/1999
JP 2001-158547 6/2001

* cited by examiner

*Primary Examiner* — Huan Tran
(74) *Attorney, Agent, or Firm* — IPUSA, PLLC

(57) ABSTRACT

A printer includes a printer main body, a lid part including a lid main body, a block unit, and a first rotation shaft providing a connection between the lid main body and the block unit, the block unit being rotatable around the axis of the first rotation shaft, a print head attached to one of the printer main body and the block unit, a platen roller attached to the other one thereof, and a second rotation shaft situated on one of two opposite side faces of the printer main body and the lid part, the second rotation shaft providing a connection between the printer main body and the lid part, and lid part being rotatable around the axis of the second rotation shaft, wherein the first rotation shaft is parallel to a longitudinal direction of the print head, and the second rotation shaft is perpendicular to the first rotation shaft.

7 Claims, 7 Drawing Sheets

PRINTER

BACKGROUND OF THE INVENTION

1. Field of the Invention

The disclosures herein relate to a printer.

2. Description of the Related Art

Printers for producing sales receipts or the like are widely used in cash registers used in stores, ATMs (automatic teller machines) or CDs (cash dispensers) installed in banks, etc. Such printers for producing sales receipts or the like have a roll of thermal paper used as a recording sheet. A thermal head or the like prints on the recording sheet while the recording sheet is advanced. After the sheet is advanced a predetermined length, a predetermined length of the recording sheet is cut from the rest of the sheet.

A printer of such a type has a printer main body and a lid part connected to the printer main body. One of a thermal head and a platen roller may be attached to the printer main body. The other one of the thermal head and the platen roller may be attached to the lid part. In order to set up a sheet in the printer having this configuration, a recording sheet is inserted through a space that is created between the printer main body and the lid part by opening the lid part.

Such a printer will be described in detail by referring to FIGS. 1A and 1B. A printer illustrated in FIGS. 1A and 1B includes a printer main body 910 and a head unit 920 that serves as a lid part. The printer main body 910 and the head unit 920 are connected together through two arms 930 that are situated near the two opposite side faces of the printer main body 910 and the two opposite side faces of the head unit 920. In this printer, a platen roller 911 is mounted in the printer main body 910. A thermal head (not shown) is mounted in the head unit 920.

FIG. 1A illustrates a state in which the thermal head can print on a recording sheet, i.e., a state in which the printer main body 910 and the head unit 920 are in direct contact with each other to form one integrated machine. In order to set up a recording sheet in the printer, the head unit 920 is lifted up from the printer main body 910 so that the printer main body 910 and the head unit 920 are separated from each other as illustrated in FIG. 1B. When the printer main body 910 and the head unit 920 are separated from each other, a space 940 is created between the printer main body 910 and the head unit 920. A recording sheet is passed through the space 940 created as described above, thereby being set up in the printer.

In the printer having the configuration illustrated in FIG. 1, a recording sheet is set up upon being passed through the space 940 that is created between the printer main body 910 and the head unit 920 by lifting up the head unit 920 from the printer main body 910. Because of this, the head unit 920 and so on interfere with the task of passing the recording sheet, which results in the need for time and labor for setting up the recording sheet in the printer. The head unit 920 may be lifted higher up from the printer main body 910 to increase the space 940, thereby reducing the time required for the task. However, such an arrangement requires the arms 930 of large size, which are not suitable for size reduction, and also give rise to a problem of insufficient strength.

Accordingly, it may be desirable to provide a printer that is of small size and configured to allow easy setup of a recording sheet.

PATENT DOCUMENT

[Patent Document 1] Japanese Patent Application Publication No. 11-129571

[Patent Document 2] Japanese Patent Application Publication No. 11-157107

[Patent Document 3] Japanese Patent Application Publication No. 2001-158547

SUMMARY

According to one embodiment, a printer includes a printer main body, a lid part connected to the printer main body, the lid part including a lid main body, a block unit, and a first rotation shaft, the first rotation shaft providing a connection between the lid main body and the block unit, and the block unit being rotatable around a first rotation axis provided by the first rotation shaft, a thermal head attached to one of the printer main body and the block unit, a platen roller attached to the other one of the printer main body and the block unit, and a second rotation shaft situated on one of two opposite side faces of the printer main body and the lid part, the second rotation shaft providing a connection between the printer main body and the lid part, and lid part being rotatable around a second rotation axis provided by the second rotation shaft, wherein the first rotation axis is parallel to a longitudinal direction of the thermal head, and the second rotation axis is perpendicular to the first rotation axis.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

In the following, embodiments will be described by referring to the accompanying drawings. The same elements are referred to by the same numerals, and a description thereof will be omitted.

Figure 1A:
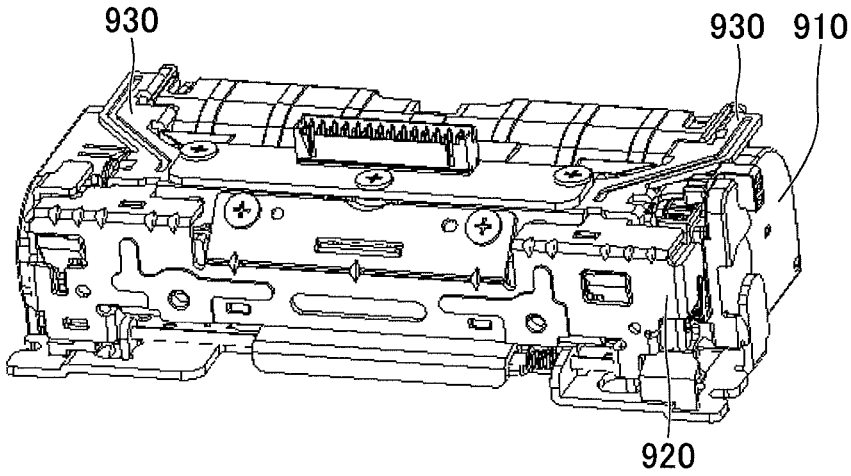
FIGS. 1A and 1B are illustrative drawings of a related-art printer.
Figure 1B:
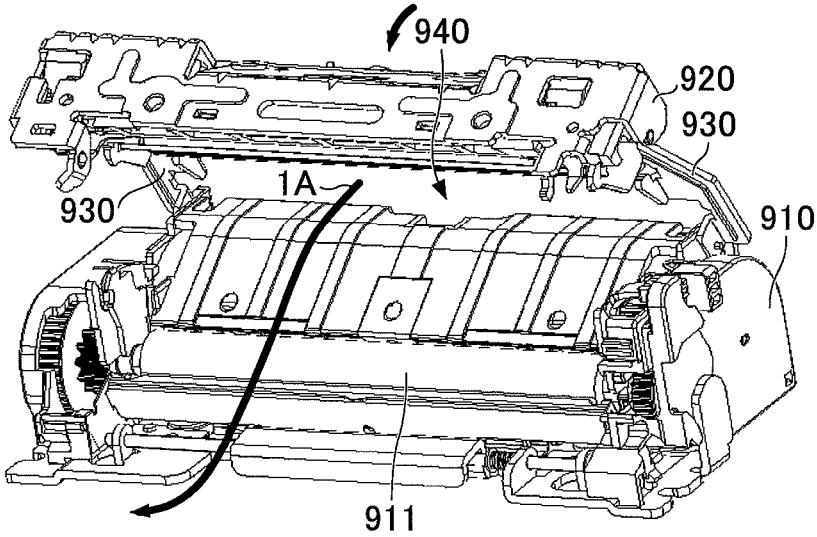
Figure 2B:
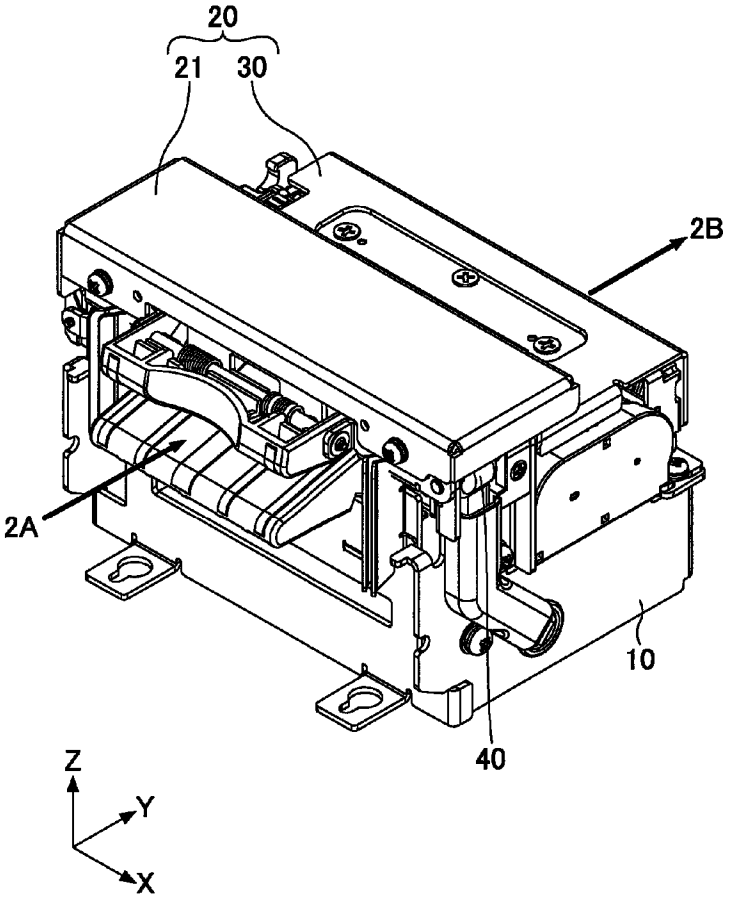
FIGS. 2A and 2B are oblique perspective views of a printer according to an embodiment with a lid part closed.
Figure 2A:
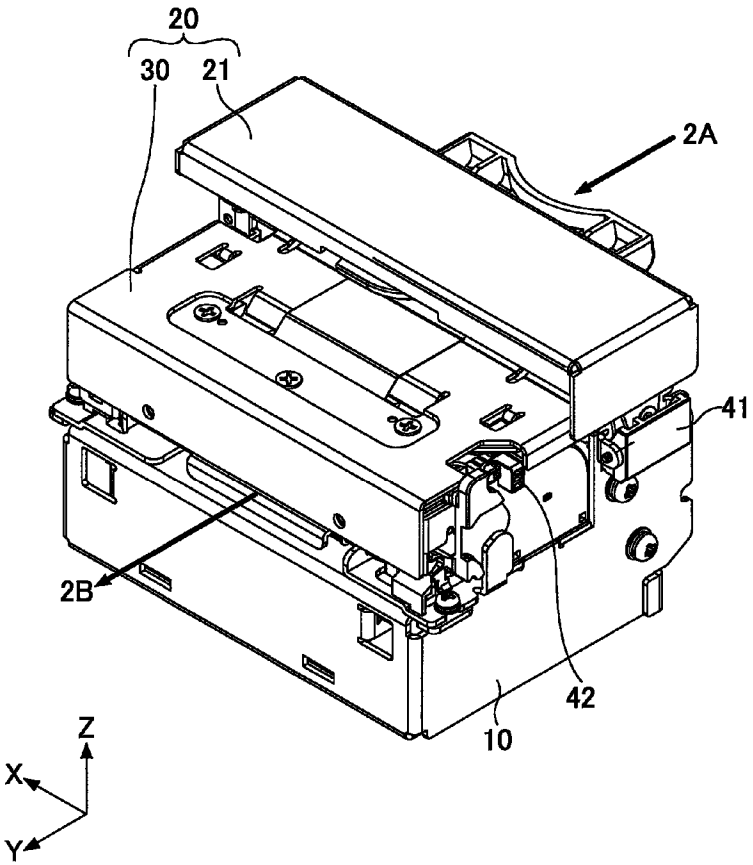
Figure 3:
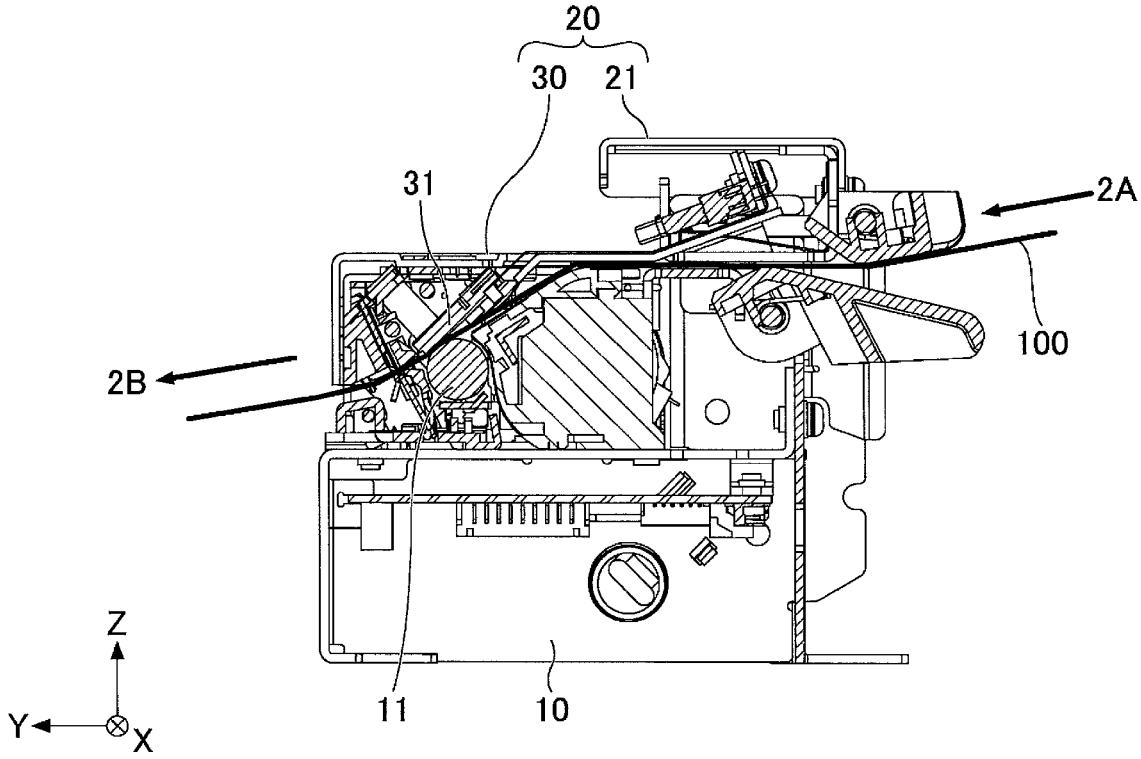
FIG. 3 is an oblique perspective view of the printer according to the embodiment with the lid part open.

A printer according to the present embodiment will be described with reference to FIGS. 2A and 2B and FIG. 3. FIG. 2A is an oblique perspective view of the printer. FIG. 2B is an oblique perspective view of the printer as viewed from the rear side thereof. FIG. 3 is a cross-sectional view of the printer. A printer according to the present embodiment includes a printer main body 10 and a lid part 20. The lid part 20 includes a lid main body 21 and a head block 30. In the present disclosures, the head block 30 may sometimes be referred to as a block unit.

The printer main body 10 and the lid part 20 are connected together through a connecting unit 40 that is situated on one of the two opposite side faces of the printer main body 10 and the lid part 20. A lock unit 41 for securing the printer main body 10 and the lid part 20 to each other is provided on the other one of the two opposite side faces of the printer main body 10 and the lid part 20. The printer according to the present embodiment has a thermal head 31 attached to the head block 30 as illustrated in FIG. 3. A platen roller 11 is attached to the printer main body 10. A recording sheet 100 travels as illustrated by an arrow 2A and an arrow 2B. In the present embodiment, the direction in which the platen roller 11 and the thermal head 31 extend, i.e., the longitudinal direction of the platen roller 11 and the thermal head 31, is denoted as an X direction.

In FIGS. 2A and 2B and in FIG. 3, the printer is in the state in which the lid part 20 is closed, i.e., in the state in which the printer main body 10 and the head block 30 are in direct contact with each other to form one integrated unit, thereby allowing the thermal head 31 to print on the recording sheet 100.

Figure 4:
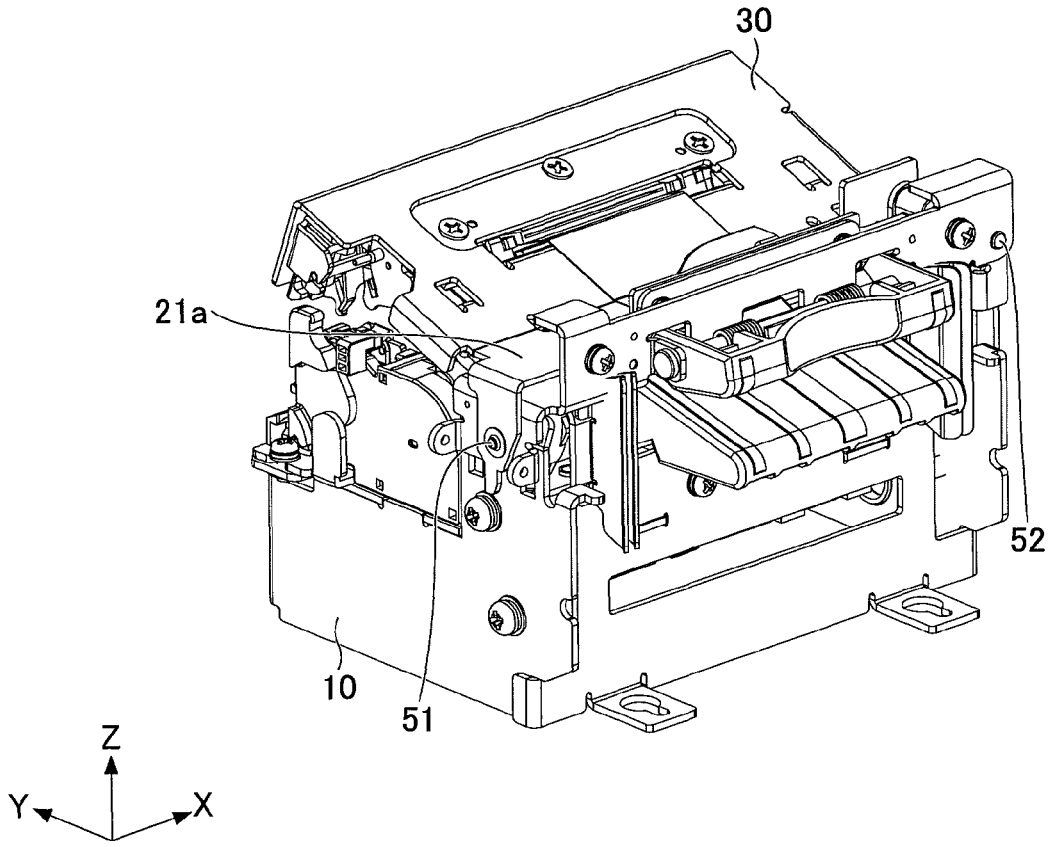
FIG. 4 is an illustrative drawing of a first rotation shaft.

FIG. 4 illustrates the printer placed in the state in which a cover and the like of the lid main body 21 are removed. As illustrated in FIG. 4, the head block 30 and a lid-unit interior member 21*a* situated in the lid main body 21 are connected to each other such that the head block 30 is rotatable around a first rotation axis provided by a first rotation shaft 51. In the present embodiment, the first rotation axis corresponds to the X axis.

Figure 5:
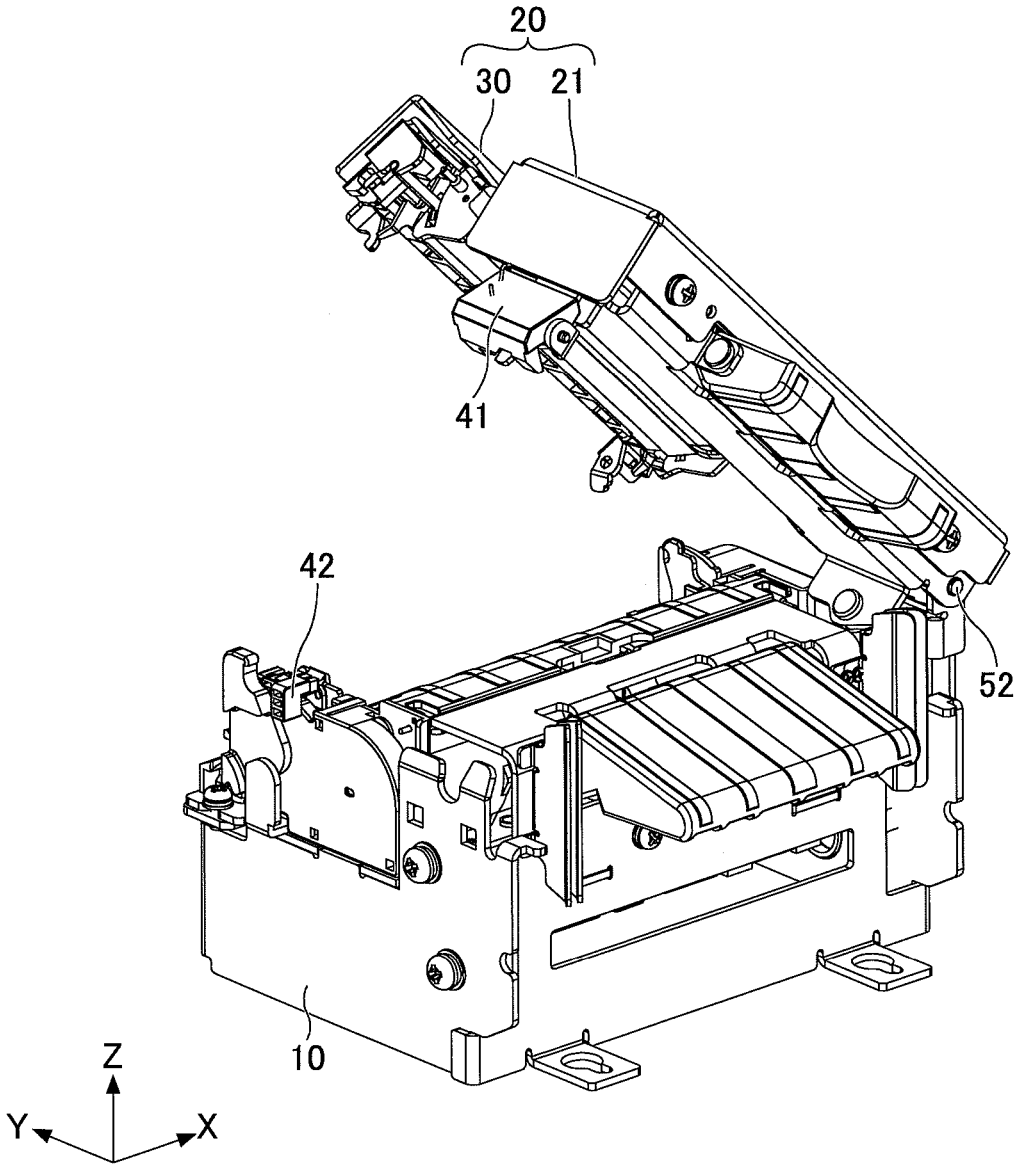
FIG. 5 is an illustrative drawing of a second rotation shaft.

As illustrated in FIG. 5, the head block 10 and the lid main body 20 are connected to each other such that the lid part 20 is rotatable around a second rotation axis provided by a second rotation shaft 52. In the present embodiment, the second rotation axis corresponds to the Y axis. Here, the X axis, the Y axis, and the Z axis are perpendicular to one another.

In the following, a description will be given of the operation to open the lid part 20 of the printer of the present embodiment with reference to FIGS. 6A and 6B and FIGS. 7A and 7B.

Figure 6B:
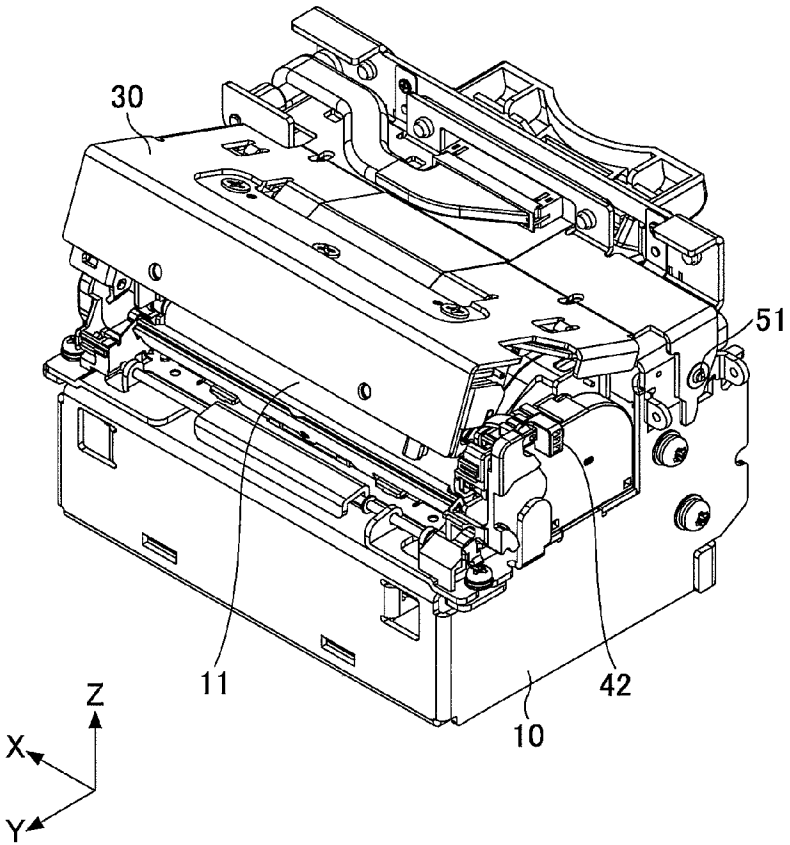
FIGS. 6A and 6B are drawings illustrating the printer of the embodiment when the lid part is to be opened.
Figure 6A:
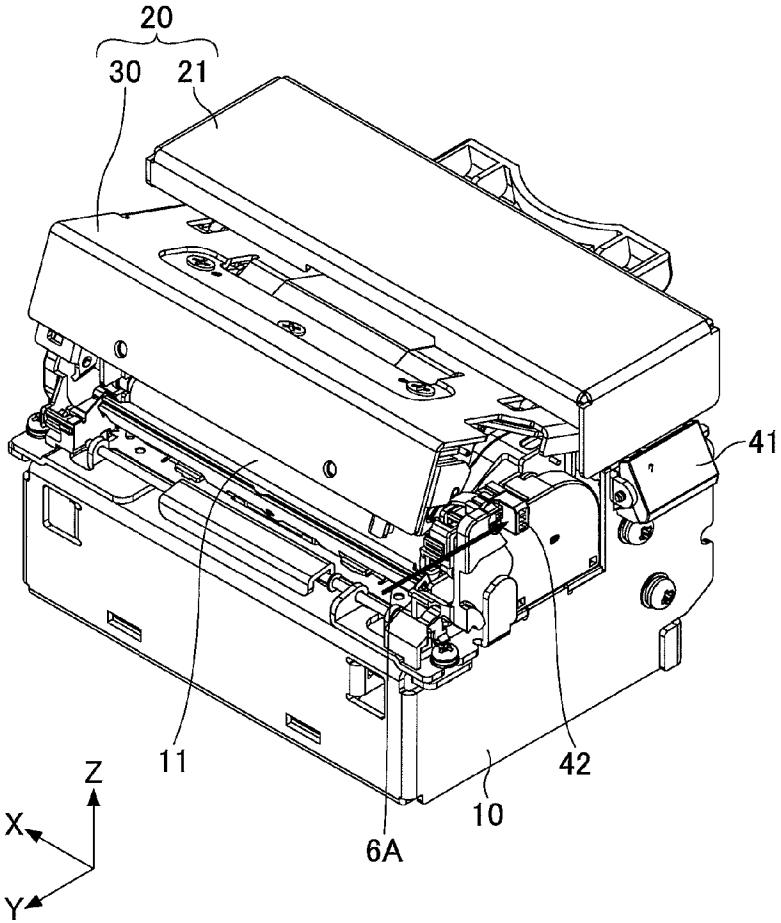

FIG. 6A is an oblique perspective view of the printer placed in the above-noted state, and FIG. 6B is an oblique perspective view of the printer illustrated in the state in which a cover and the like of the lid main body 21 are removed. As illustrated in FIG. 6A, a head lever 42 is moved in the direction indicated by an arrow 6A to rotate the head block 30 around the first rotation shaft 51 corresponding to the X axis, thereby lifting up the head block 30 in the direction of the positive Z axis from the closed state illustrated in FIGS. 2A and 2B and FIG. 3. This direction coincides with the direction in which the platen roller 11 is separated from the thermal head 31. As a result of the above-noted movement, thus, the platen roller 11, which was initially in contact with the thermal head 31, is separated from the thermal head 31.

Subsequently, the lock unit 41, which is situated on one of the two opposite side faces of the printer main body 10 and the lid part 20 to secure the lid part 20 to the printer main body 10, is unlocked. The one of the two opposite side faces of the lid part 20 on which the lock unit 41 is situated is then lifted up in the direction of the positive Z axis.

Figure 7B:
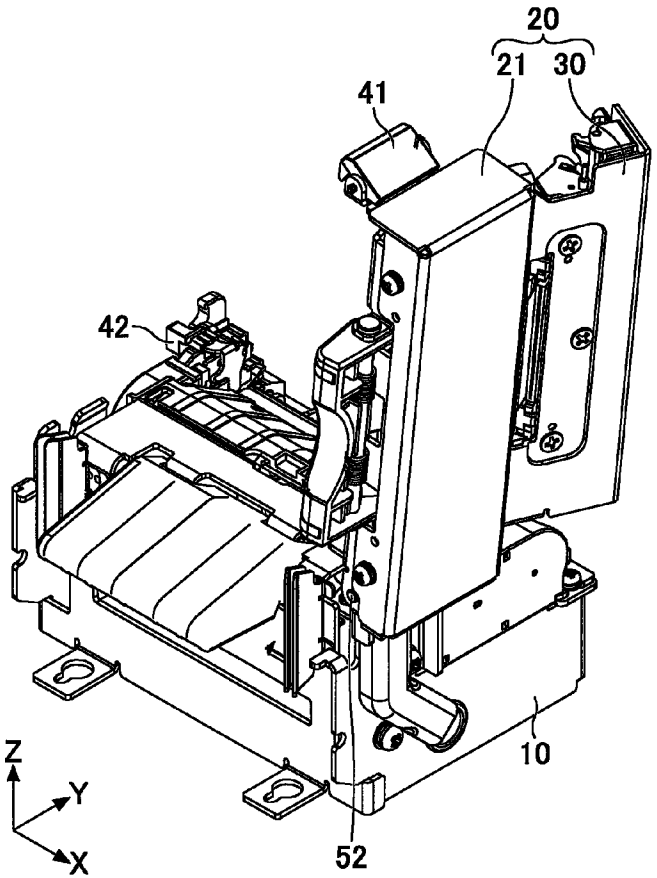
FIGS. 7A and 7B are oblique perspective views of the printer of the embodiment with the lid part open.
Figure 7A:
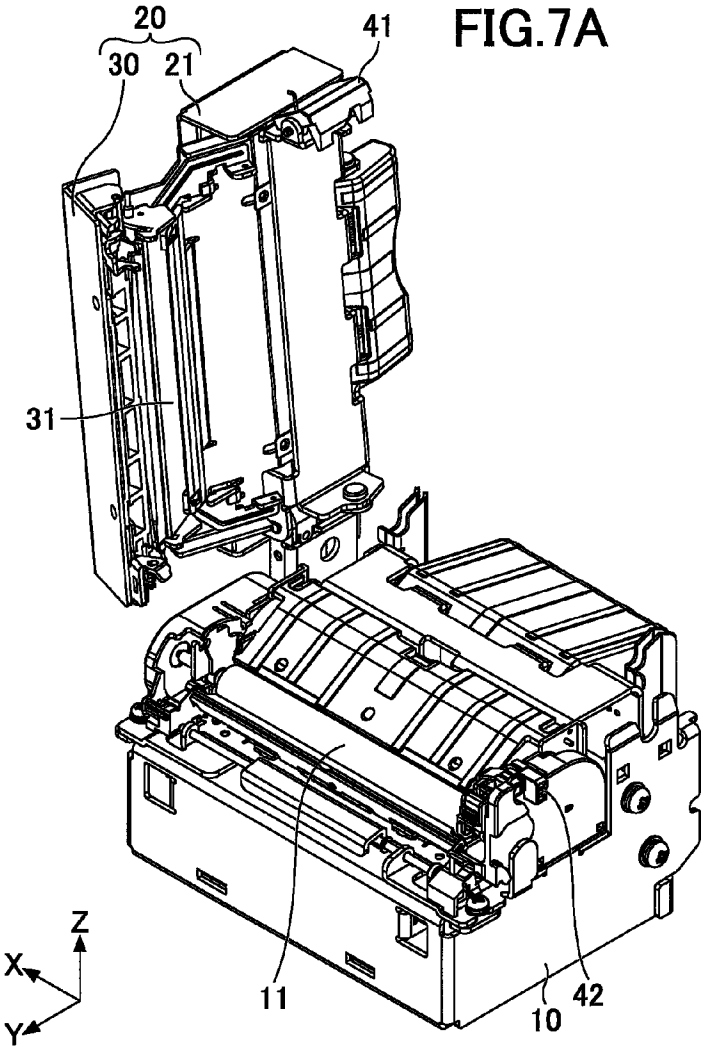

FIGS. 7A and 7B illustrate the printer with the lid part 20 open, i.e., the printer placed in the state in which a recoding sheet can be set up. FIG. 7A is an oblique perspective view of the printer of the present embodiment in the above-noted state as viewed from the front side thereof. FIG. 7B is an oblique perspective view of the printer as viewed from the rear side thereof. As illustrated in FIGS. 7A and 7B, the lid part 20 is rotated around the Y axis about the second rotation shaft 52 that is provided close to one of the two opposite side faces of the printer main body 10 and the lid part 20. As a result, the lid part 20 is opened such that the other one of the two opposite side faces of the lid part 20 faces upward.

When the printer is placed in the state in which the lid part 20 is open as illustrated in FIGS. 7A and 7B, the lid part 20 is not situated immediately above the platen roller 11 provided in the printer main body 10. With this arrangement, a recording sheet can easily be set up. In the configuration in which the lid part 20 has the head block 30 to which the thermal head 31 is attached, the size of the head block 30 tends to be large because the thermal head 31 is relatively larger than the platen roller 11. The head block 30 thus tends to interfere with the task of setting up a recording sheet. In the case of the printer of the present embodiment, however, the head block 30 is rotated around the first rotation axis provided by the first rotation shaft 51, and, also, the lid part is rotated around the second rotation axis provided by the second rotation shaft 52. In this state, the head block 30 is not in existence immediately above the platen roller 11 provided in the printer main body 10. This arrangement allows a recording sheet to be easily set up.

The disclosed configuration is applicable to a printer that has a platen roller 11 mounted to the lid part 20, and has a thermal head 31 mounted to the printer main body 10. In such a case, a block unit to which the platen roller 11 is attached, rather than the head block 30, is connected to the lid part 20.

In this manner, the printer is placed in the state as illustrated in FIGS. 7A and 7B, and, then, a recording sheet (not shown) is set up. Thereafter, the lid part 20 is rotated in a closing direction around the second rotation shaft 52 situated close to one of the two opposite side faces of the lid part 20, so that the lid part 20 comes in contact with the printer main body 10. The lock unit 41 situated on the other one of the two opposite side faces of the printer main body 10 and the lid part 20 is used to provide a locked state. The lock unit 41 may have one or more pins that engage recesses or holes provided in the side face of the printer main body 10 or the lid part 20 in order to provide the locked state. The head block is then rotated around the first rotation shaft 51 to move in the direction of the negative Z axis, so that the thermal head 31 and the platen roller 11 come in contact with each other with a recording sheet intervening therebetween. In this manner, a recording sheet is set up in the printer of the present embodiment.

A printer that is different from the printer of the present embodiment, configured such that only the lid part rotating around the second rotation shaft brings the platen roller 11 and the thermal head 31 in contact with each other, the pressure that the thermal head 31 and the platen roller 11 apply to each other may differ between one side end of the thermal head 31 and the platen roller 11 and the other side end of the thermal head and the platen roller 11. If this is the case, the quality of printing may not be the same between one side end of a recording sheet and the other side end of the recording sheet when the thermal head 31 prints on the recording sheet. For example, faded letters may be printed on one side or the other side of a recording sheet.

On the other hand, the printer of the present embodiment is configured such that the lid part 20 is rotated around the second rotation shaft 52, and, the head block 30 is rotated around the first rotation shaft 51. Accordingly, the pressure that the thermal head 31 and the platen roller 11 apply to each other is even between one side end of the thermal head 31 and the platen roller 11 and the other side end of the thermal head 31 and the platen roller 11. This ensures that the thermal head 31 prints evenly on a recording sheet, thereby preventing the quality of printing on the recording sheet by the thermal head 31 from being degraded.

Further, although the present invention is not limited to these embodiments, but various variations and modifications may be made without departing from the scope of the present invention.

The present application is based on Japanese priority application No. 2012-188053 filed on Aug. 28, 2012, with the Japanese Patent Office, the entire contents of which are hereby incorporated by reference.

What is claimed is:

1. A printer, comprising:

a printer main body;

a lid part connected to the printer main body, the lid part including a lid main body, a block unit, and a first rotation shaft, the first rotation shaft providing a connection between the lid main body and the block unit, and the block unit being rotatable around a first rotation axis provided by the first rotation shaft;

a print head attached to one of the printer main body and the block unit;

a platen roller attached to the other one of the printer main body and the block unit; and a second rotation shaft situated on one of two opposite side faces of the printer main body and the lid part, the second rotation shaft providing a connection between the printer main body and the lid part, and the lid part being rotatable around a second rotation axis provided by the second rotation shaft, wherein the first rotation axis is parallel to a longitudinal direction of the print head, and the second rotation axis is perpendicular to the first rotation axis.

2. The printer as claimed in claim 1, wherein the printer head is mounted to the block unit.

3. The printer as claimed in claim 1, wherein the printer main body and the lid part are secured to each other through a lock unit that is situated on the other one of the two opposite side faces of the printer main body and the lid part.

4. The printer as claimed in claim 1, wherein in order to open the lid part, the block unit is rotated around the first rotation axis provided by the first rotation shaft in such a direction that the printer head and the platen roller are separated from each other, and, thereafter, the lid part is rotated around the second rotation axis provided by the second rotation shaft in such a direction that the lid part is opened.

5. The printer as claimed in claim 1, wherein the block unit is rotated around the first rotation axis provided by the first rotation shaft to separate the print head and the platen roller from each other after an initial state in which the print head and the platen roller are in contact with each other.

6. A printer, comprising:

a printer main body;

a lid part, that includes a lid main body and a block unit connected to each other through a first rotating shaft in a manner that the block unit is rotatable around a first rotation axis;

a print head attached to one of the printer main body and the lid part;

a platen roller attached to the other one of the printer main body and the lid part; and a connecting part that connects the print main body and the lid part in a manner that the lid part is rotatable around a second axis;

wherein the first rotation axis is parallel to a longitudinal direction of the print head, and the second rotation axis is perpendicular to the first rotation axis.

7. A printer, comprising:

a main body on to which a platen is provided;

a lid part including a lid main body that is rotatably connected to the main body around a first rotation axis, a block unit on to which a print head is provided so as to facing the platen, and is rotatably connected to the lid part around the second rotation axis;

wherein the second rotation axis is parallel to a longitudinal direction of the print head, and the second rotation axis is perpendicular to the first rotation axis.

* * * * *